United States Patent [19]

Schena et al.

[11] 4,090,838

[45] May 23, 1978

[54] CATALYST GENERATOR

[75] Inventors: Kenneth R. Schena, Silvermine Rd., West Boxford, Mass. 01855; Michael Selley, Merrimack, N.H.

[73] Assignee: Kenneth R. Schena, Haverhill, Mass.

[21] Appl. No.: 667,877

[22] Filed: Mar. 17, 1976

[51] Int. Cl.[2] ..... F23J 7/00

[52] U.S. Cl. ..... 431/4; 123/25 R; 137/3; 261/18 A

[58] Field of Search ..... 431/2, 3, 4, 126, 190; 261/18, 18 A, 124, 122; 137/3; 123/25 R, 25 A

[56] References Cited

U.S. PATENT DOCUMENTS

| | | | |
|---|---|---|---|
| 3,212,553 | 10/1965 | Cathala | 431/10 X |
| 3,862,819 | 1/1975 | Wentworth | 431/4 |
| 3,892,519 | 7/1975 | Reed et al. | 431/4 X |
| 3,924,648 | 12/1975 | Etter | 137/3 |

*Primary Examiner*—Edward G. Favors

*Attorney, Agent, or Firm*—Sewall P. Bronstein; David G. Conlin

[57] ABSTRACT

Apparatus and method for improving the efficiency of combustion, particularly in internal combustion engines, are disclosed. Air is circulated at a substantially constant, controlled rate from a blower or compressor through a control valve to a plurality of release points beneath a catalyzing or catalyst-forming liquid, such as water, and is released in such a manner as to ensure the slow growth of relatively large bubbles. These bubbles break at the liquid surface, and the catalyst-laden air is then returned to the gas impelling means, e.g. blower or compressor, in which it is mixed with more air and returned to the system. A portion of the catalyst-laden air is directed to the combustion device, e.g. the carburetor or intake manifold of an internal combustion engine, the remainder being returned to contact with the catalyzing or catalyst-forming liquid.

11 Claims, 4 Drawing Figures

CATALYST GENERATOR

BACKGROUND OF THE INVENTION

This invention relates to the improvement of combustion and fuel-burning devices, such as internal combustion engines, and oil, gas or coal burners, as used in industrial or home heating. The method and device disclosed are used to particular advantage in connection with internal combustion engines.

It is known that combustion devices which burn hydrocarbon fuels generally are more efficient and economical when supplied with moisture-laden air or droplets of water suspended in air to the manifold to be mixed with the vaporized fuel. See, e.g., U.S. Pat. Nos. 1,618,602, Meyers, 1,775,263, Wiegland, and 3,814,567, Zink. The reason for the increase in combustion efficiency is unclear, particularly since water is a reaction product from the combustion of hydrocarbon fuels, and the presence of reaction product in a reaction medium would generally be expected to drive the reaction in the opposite direction or at least slow it down. It has been postulated that the water vapor acts catalytically to aid in combustion. See U.S. Pat. No. 3,862,819 to Wentworth. Others, such as Zink, supra, have suggested that the water acts as a source of hydrogen which aids in more complete combustion of the carbon. Some have bubbled air through a water layer which is coated with a layer of oil or other hydrocarbon before injecting it into the combustion zone, e.g. Wentworth, supra, and U.S. Pat. No. 1,618,602 to Meyers et al. In such systems, it is possible that the water reacts with other components in the system to produce catalysts or other highly reactive fuels. At any rate, whatever the precise mechanism by which the efficiency is increased, some increase in efficiency has previously been recognized. The term "catalyst" and the like, as used herein, is intended to denote a substance which when added to a combustion mixture enhances the combustion, or forms a further product which enhances the combustion, whatever specific mechanism is involved.

In spite of the fact that this phenomenon has long been known, no device which employs the phenomenon to improve the efficiency of internal combustion engines, oil or gas burners or the like, has been commercially adopted by the automotive or heating industry. The reason for this is believed to be that previously known devices for infusing water vapor or other catalytic vapors into the combustion mixture have not proven to result in the expected increase in efficiency and performance on a dependable basis.

With regard to internal combustion engines, there have been a larger number of different approaches taken in attempts to solve the problems involved and develop a reliable device. Many, such as Meyers, U.S. Pat. Nos. 1,618,602, Wiegland, 1,775,263, Stover, 1,960,982, and Stephenson, 3,790,319, rely on the vacuum which occurs in the inlet manifold or is produced in the air line which feeds the inlet manifold to draw moisture-laden air from a water-containing chamber, the air having previously been enriched in water content by bubbling through the water in the chamber. In this way, increased amounts of moisturized air would be supplied when the carburetor demand is increased, e.g. when the accelerator is depressed. Others, such as Hayes, U.S. Pat. Nos. 1,556,109, and Andrews, 1,854,607, have utilized fans or air pumps driven by the engine in order to force air through a moisturizing apparatus from whence it enters the carburetor and is mixed with the fuel to form the combustion mixture. The alleged advantage of these systems is that the engine is supplied with greater amounts of moisturized air when the engine runs faster. Still other systems, including Atwood, U.S. Pat. Nos. 1,417,483, Davis, 1,685,598, and Mellinger, 2,835,233, inject water directly, either in the form of a fine spray or as a vapor of steam, into the gas supply to the engine rather than humidifying air and then injecting the humidified air. See also Vericamp, U.S. Pat. Nos. 3,809,523, and Wentworth, 3,862,819, for the injection of water in systems other than internal combustion engines, e.g. oil or gas burners.

It is accordingly an object of the present invention to provide an apparatus which is effective in decreasing fuel consumption and improving performance of fuel-burning devices.

It is a particular object of the invention to decrease fuel consumption and improve performance of internal combustion engines.

It is a further object of this invention to provide a device which provides consistent improvement in performance and fuel consumption of a wide range of operating conditions and for a wide variety of combustion apparatus.

It is a further object to provide such a device in which the operation of the device is easily and precisely controlled and adjusted to maximize its effect, such device being easy to manufacture, install and use.

It is a still further object to provide a method of improving the combustion of hydrocarbon fuels, such as petroleum or fractions or derivatives of petroleum, which increases the combustion efficiency and decreases the fuel consumption in hydrocarbon fuel burning devices.

These and other objects and advantages will be appreciated by the skilled in the art from a consideration of the present specification, or from a practice of the invention disclosed in the following description, taken in connection with the next drawings, in which.

Figure 3:
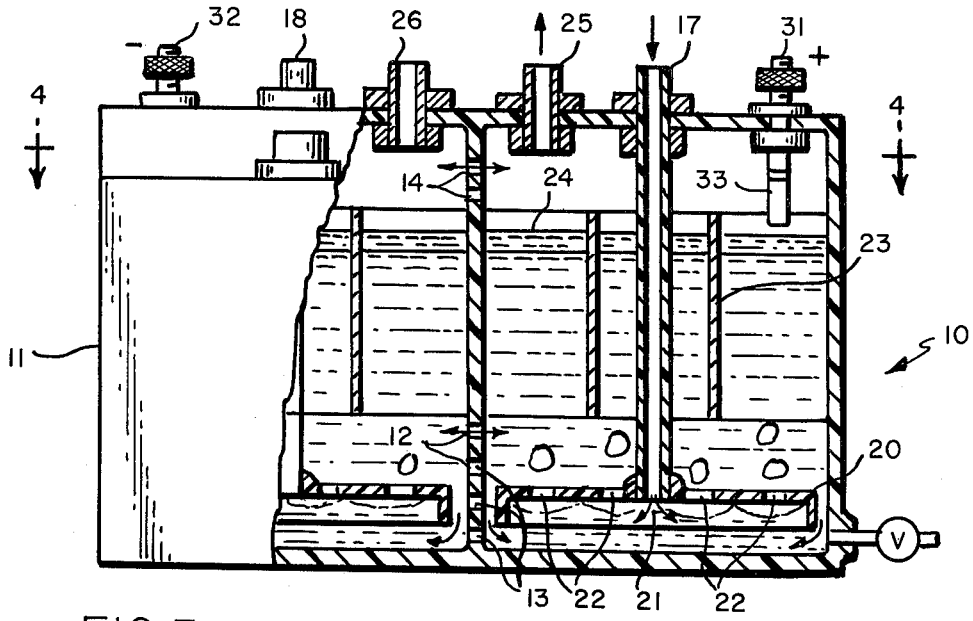
FIG. 3 is a frontal view, partially in section, along line 3—3 of FIG. 2.
Figure 4:
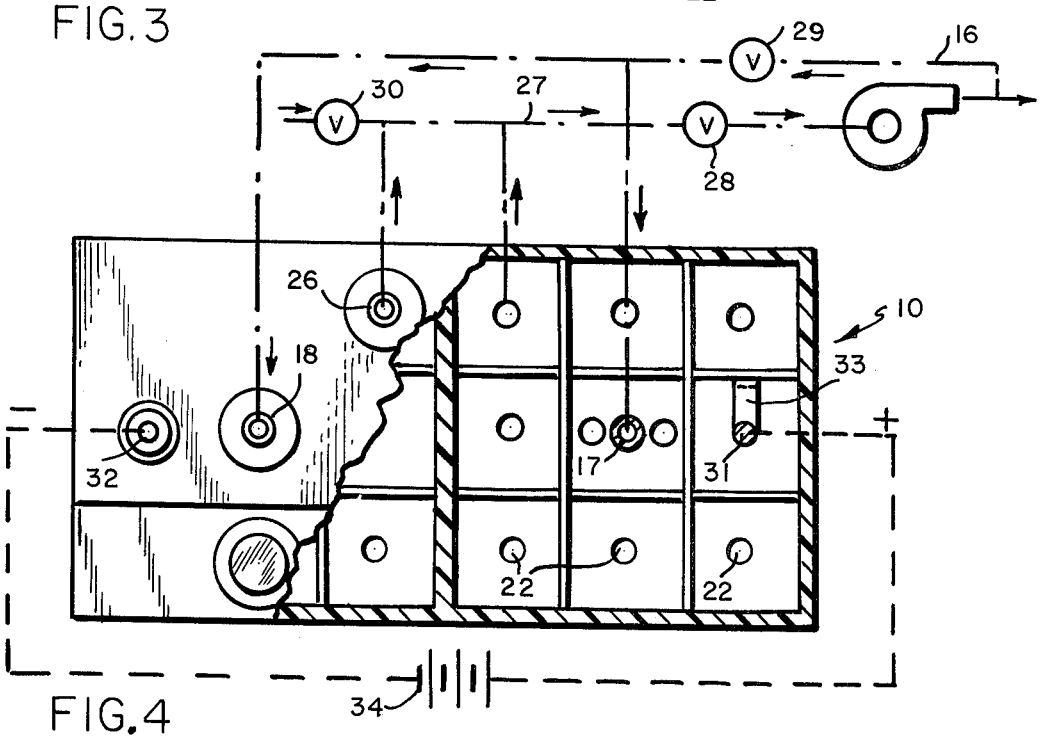

FIG. 4 comprises a top view of the device, partially in section, along line 4—4 of FIG. 3, schematically indicating the connection of the various parts of the device to a battery and to a blower.

BRIEF DESCRIPTION OF THE INVENTION

Basically the invention involves a system which includes means for providing air under pressure, such as a compressor, fan or blower, which operates at a substantially constant level, the air output of such means being connected to at least one contact or bubbler chamber, for conveying a portion of the output air to a point beneath the surface of the water or other material which is desired to infuse into the combustion mixture, and means for forming such air into a plurality of relatively large, slowly growing bubbles, which then float to the surface and burst, disgorging the air which has been in contact sufficiently to pick up some of the liquid. The catalyst-laden gas is then conveyed out of the contact chamber and back to the input side of the gas conveying device. Preferably the means for producing the plurality of bubbles is a generally elongate member having a plurality of openings submerged beneath the surface through which air from the blower is released into the catalyst. Other means may be used, e.g. a plurality of tubes or a manifold. The device of the present invention supplies the air to the chamber operation at essentially constant speed, i.e. not, as in previous devices, in response to the engine speed or engine or manifold vacuum. Thus while intake manifold vacuum will increase the throughput to some extent by reducing the resistence to air flow downsteam, the speed of the air impeller, and the rate of air flow through the bubble chamber remains substantially constant as contrasted with prior art devices.

It is quite surprising that the constant flow system of the present invention, which in essence ignores engine demand, should produce increased and more consistent improvements in combustion efficiency, as compared with systems which increase the output of treated air in response to increased engine demands. Without wishing to be bound by the theory of operation of this device, it is believed that its improved performance is obtained, at least in part, because of the close control it provides over the rate of bubble production and the nature of the bubbles which are formed. Preferably the present invention utilizes means for controlling air flow both in the feed line to the bubble chamber and in the exit line from the bubble chamber. Preferably valves, such as ball valves, needle valves, butterfly valves or gate valves, are used as these flow controllers, but other known means such as sized orifices can also be used. Utilizing this dual control system, both the amount of pressure transmitted to the bubbler input from the output side of the gas supply device and the amount of vacuum applied to the bubbler output, e.g. from the suction side of the gas supply device, can be controlled relatively precisely.

Preferably also the contact chamber contains at least one aqueous layer, and electrodes are provided in the aqueous layer to convey a small but effective amount of current through that layer. It surprisingly appears that even when only small amounts of current are passed through such a layer during operation of the device of the present invention, the effect of the device is still further enhanced, resulting in even greater efficiency and fuel savings. Again, the reason for this is not clearly known. While not wishing to be bound by theory, it is possible that some electrolysis of the water occurs, producing hydrogen in the atmosphere near one electrode and/or enriching the oxygen in the atmosphere near the other electrode. Where electrolytes are added to the aqueous layer, as preferred, some depletion of the electrolytes also may occur.

For example, an aqueous layer may have added to it a small amount of oxalic acid, with sufficient base, e.g. sodium hydroxide, to keep the pH about neutral. Initially such a layer in an operating device will have a clear to slightly aqua color, and may have some haze. At some point in the operation, particularly where the aqueous layer is being operated in conjunction with a supernatant oil layer, the aqueous layer will turn brown to dark brown or dark grey-brown, and the increase in combustion efficiency is somewhat diminished. Addition of new oxalic acid to the mixture revitalizes the aqueous layer and changes the color from dark brown to various shades of aqua.

Only small amounts of current are utilized with the present invention, and beneficial results are achieved even without addition of electrolyte to the aqueous layer and electrodes in that layer being simply connected to the standard 12 volt automobile battery. The current through the aqueous layer during operation should be sufficient to provide an additional increase in combustion efficiency, but not so high as to create a power drain which would substantially offset the increase in combustion efficiency. Generally the current should be between about 0.001 and 1.0 amp, preferably between about 0.01 and 0.2 amp. With a given voltage, the current carried by a system can be adjusted in known manner by adding a particular amount or type of electrolyte, or by increasing the resistance across the device, e.g. by connecting a variable resistance so as to make the total resistance variable. The amount of electrolyte to be used depends primarily on the current level desired. Using oxalic acid, for example, satisfactory results have been obtained with only about 0.22 g/l (0.025M) and sufficient sodium hydroxide to bring the pH back to about 6.5.

The electrolytes usable in the present invention include all compounds which have at least one easily dissociable form and which do not produce under electrolysis substances which are deleterious to the system. Standard acids, bases and salts usable for this purpose are well known in the art. It is particularly preferred to use such materials which have at least one fairly weakly dissociating state, so that some buffering action takes place in the aqueous layer and rapid change in pH in response to depletion of ingredients is minimized. Difunctional organic acids, such as carbonic, citric, fumaric, itaconic, maleic, malic, malonic and oxalic acids and salts thereof, are particularly well suited in that regard, as are some organic bases such as the amines, e.g. phenylene diamine. In addition to providing the buffering capacity, these materials do not give off noxious or corrosive products such as oxides or sulphur or nitrogen, cyanide, etc. The pH of the solution is preferably between about 4 to 9, more preferably between about 6 and 7.

Turning to the drawings, FIGS. 1–4 depict one embodiment of the present invention, generally indicated at 10. It has a casing 11 which internally is divided by partition member 12. This partition 12 provides openings 13 between the two chambers below the liquid surface and openings 14 in the partition above the liquid surface. Openings 13 provide for equallization of fluid level, some intermixing between chambers and, in those embodiments employing electrodes, a path for the current through the partition. Openings 14 provide for equallization of pressure between chambers, and also allow some intermixing of the catalyst-laden atmosphere in those chambers.

Part of the output of a gas impelling device, shown schematically at 15 in FIG. 4, is taken by line and supplied to contact device 10 via supply tubes 17 and 18. The remainder of the output of the gas impelling means 15 is conveyed to the combustion apparatus (not shown) via bin 19. The gas impelling device may be a blower, a compressor, or any of many gas conveying devices well known in the art.

Figure 1:
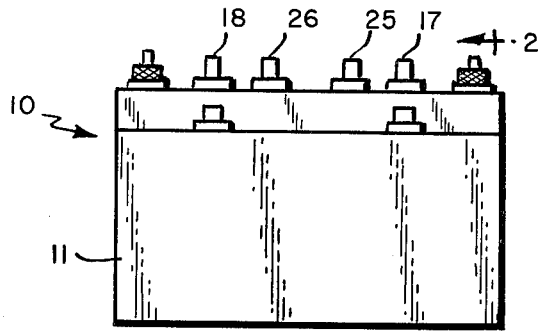
FIG. 1 is a frontal planar view of one embodiment of the apparatus of the present invention.
Figure 2:
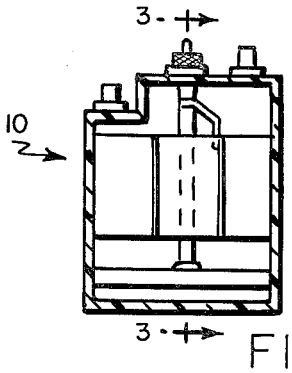
FIG. 2 is a side view, in section, taken on line 2—2 of FIG. 1.

The air thus obtained is conveyed by tubes 17 and 18 beneath the liquid surface to a gas distributing device 20. As shown in FIGS. 2 and 3, the gas distributing device is a generally inverted U-shaped member, having a central opening 21 through which the supply tube feeds air and a plurality of openings 22, which allow the bubbles to form and pass upwardly through the contacting liquid. Preferably these openings 22 are of a size which forms relatively large, slowly growing bubbles which contact the aqueous layer during their journey to the surface. Preferably these bubbles should average between about 0.4 and 1.5 inches in diameter, more preferably between about 0.5 and 1.0 inch and most preferably around 0.75 inch, e.g. between about 0.6 and 0.8 inch. Preferably the bubble growth rate is from about two bubbles per second at each opening to one bubble about every 2 seconds, more preferably a bubble about every 0.8 to 1.2 seconds.

As shown each major compartment has a partition 23 extending for a distance beneath the water level, which divides the liquid into a plurality of semi-compartments. In this case, as best shown in FIG. 4, partition 23 takes the form of a rectangular honeycomb of vertical walls which extend in two directions with the device. Preferably the gas distributor 20 is so arranged as to provide a gas contact opening 22 approximately within each of the semi-compartments formed by the partition, which arrangement tends to stabilize the flow of the contacting air bubbles within the device, and gives the effect of a multitude of small contact devices without requiring numerous complicated supply and withdrawal means.

It is also preferred to utilize non-miscible supernatant layer 24, which reduces the amount of surface turbulence, and may add to the catalytic-or combustion-supporting nature of the product formed. Non-miscible motor oils or other petroleum-based oils can be used, as may non-miscible oils from other sources, e.g. vegetable or other natural oils, or silicone oils.

Having traversed the body of liquid, and also the oil layer 24, if any, the catalyst-laden air collects above the liquid surface and is carried back to the input of the gas conveying means 15 via outlets 25 and 26 and suitable conduits, indicated schematically at 27 in FIG. 4. As previously indicated, it is preferred in commercial embodiments of the invention that both supply line 16 and catalyst line 27 be provided with valves (28 and 29 in FIG. 4) by the flow therethrough.

The system requires some make-up air to match the catalyst-laden air supplied to the combustion device via line 19. It has been found most preferable to accomplish this by supplying a bleed valve 30 connected to the catalyst line 27, so that the outside air can be controlled in amount and intimately mixed with the catalyst-laden air prior to being fed into the air impelling means 15. However, the make-up air can be fed into the system at any other point, e.g. directly into the air impelling means itself.

As previously discussed, the preferred device also employs an anode 31 and a cathode 32, to electrolytically assist in the operation of the device. In the embodiment depicted in the drawings, the anode 31 and the cathode 32 are connected to the honeycomb partition 23 in their respective chambers, by means of a conductive connector 33, and partition 23 is conductive. This has the effect of making each partition into an electrode, and providing the entire surface of the partition for current transfer to the liquid. In one embodiment of the invention, the partition connected to the anode is made out of iron, and the partition connected to the cathode is made of aluminum, this device being designed for operation with a standard 12 volt battery. Other suitable electrode materials, e.g. carbon, metals and alloys, including copper, zinc, tin, lead, etc., as well as combinations of electrodes for use with alternating current rather than direct current, are well known in the electrolysis art and need not be gone into here. See, e.g. Van Nostrand Encyclopedia of Chemistry, pp 362–374, incorporated herein by reference.

It is preferred that the system be designed so that the amount of catalyst-laden air supplied to the combustion device comprises from about 0.005 to about 10.0% by volume of the total combustion air supplied to the combustion device. Most preferably the amount of catalyst-laden air is from about 0.02 to 0.2% by volume of the total combustion air. With those systems to be used with internal combustion engines, there also appears to be a relationship between the volume of liquid in the contact device and the volumetric displacement of the internal combustion engine. Preferably the volume of liquid in the contact device is from about 0.1 to about 10 times, more preferably from about 0.5 to about 2 times the volumetric displacement of the internal combustion engine. Quite surprisingly, improvements in fuel economy of up to 30% have been achieved utilizing a device of the present invention having a volumetric capacity about equal to the displacement of the engine on which it was used.

The device of the present invention is usable with liquids other than aqueous liquids, or aqueous liquids with a supernatant oil layer. An aqueous solution may contain other ingredients in addition to electrolytes, if used, such as corrosion inhibitors, buffers, defoaming agents, surface active agents, antifreeze ingredients, as well as water miscible ingredients which may also be picked up by the air being contacted and may aid in burning or may themselves be burned. Where a supernatant non-miscible layer is used, it too may contain one or more of such ingredients, but care should be taken that neither layer contains ingredients of a type or quantity to substantially adversely affect the non-miscibility of the two layers. Suitable buffering additives include weak acids, bases and salts thereof, e.g. boric, carbonic, phosphoric, phosphorous, sufrous acids or alkali and/or alkaline earth metal salts thereof, ammonium hydroxide or halide, sulfate, etc., salts thereof, or basic amines or hydrazine. Water miscible lower molecular weight organic acids, e.g. formic acid, acetic acid, citric acid, malic acid, oxalic acid, etc., may also be used to advantage. Suitable antifreeze ingredients include lower molecular weight alcohol and polyols, e.g. methanol, ethanol, isopropanol, ethylene glycol, glycerine, etc. Suitable anti-corrosion, anti-foaming and surface active agents are known in the art. Dyes or other ingredients may also be added. These ingredients may be added to the liquid or in some instances can be formed in situ.

The device can also be used with non-aqueous liquids, e.g. with gasoline, kerosine, organic cleaners, catalysts or other materials.

While particular embodiments of the present invention have been described, they are intended to be exemplary only, with the true scope and spirit of the invention being indicated in the following claims.

We claim:

1. Apparatus for improving the efficiency of combustion in a combustion device, comprising chamber means for holding a liquid, supply conduit means extending beneath the surface of said liquid for supplying a gas to a point beneath said surface, distributor means for forming a plurality of large, slowly growing bubbles of gas beneath said surface for contact with said liquid, and outlet conduit means for carrying the gas which has contacted said liquid out of said chamber means; said distributor means further comprising means for forming gas bubbles of the average size of between about 0.4 and 1.5 inches in diameter.

2. The apparatus of claim 2, wherein the distributor means comprises means for forming gas bubbles of the average size of about 0.6 and 0.8 inch in diameter.

3. The apparatus of claim 1, further comprising gas impeller means, the output of said gas impeller means being connected to said supply conduit means, said output conduit means being connected to the input for said gas impeller means, and said gas impeller means being adapted to operate at a substantially constant speed.

4. The apparatus of claim 3, further comprising flow control means in said supply conduit.

5. The apparatus of claim 4, further comprising flow control means in said output conduit.

6. Apparatus for improving the efficiency of combustion in a combustion device, comprising chamber means for holding a liquid, supply conduit means extending beneath the surface of said liquid for supplying a gas to a point beneath said surface, distributor means for forming a plurality of large, slowly growing bubbles of gas beneath said surface for contact with said liquid, outlet conduit means for carrying the gas which has contacted said liquid out of said chamber means and means for subjecting said liquid to an electric current.

7. The apparatus of claim 6, wherein said means for subjecting said liquid to an electric current comprising an anode and a cathode at least partially immersed in said liquid, said anode and cathode being connected to a voltage source having sufficient voltage to cause a current in said liquid of from about 0.001 to about 1.0 amp.

8. The apparatus of claim 7, wherein said voltage source has sufficient voltage to cause a current in said liquid of 0.1 to about 0.2 amp.

9. A method of improving combustion efficiency contacting air with a liquid catalyst passing an electric current through said liquid while said contacting is taking place, and conveying the air so contacted into the combustion device.

10. The method of claim 9, wherein said liquid catalyst comprises water.

11. The method of claim 10, wherein said electric current is from about 0.001 to 1.0 amp.

* * * * *

UNITED STATES PATENT AND TRADEMARK OFFICE

CERTIFICATE OF CORRECTION

PATENT NO. : 4,090,838

DATED : May 23, 1978

INVENTOR(S) : Kenneth R. Schena and Michael Selley

It is certified that error appears in the above-identified patent and that said Letters Patent are hereby corrected as shown below:

Column 7, Claim 2, line 1 Change "The apparatus of Claim 2" to ---The apparatus of claim 1---

Signed and Sealed this

*Fifth* Day of *December 1978*

[SEAL]

*Attest:*

RUTH C. MASON
*Attesting Officer*

DONALD W. BANNER
*Commissioner of Patents and Trademarks*